US011747110B2

(12) United States Patent
Kozak

(10) Patent No.: US 11,747,110 B2
(45) Date of Patent: Sep. 5, 2023

(54) FIREARM ARTICLE SUSPENSION SYSTEM

(71) Applicant: KORE Essentials Inc., La Mesa, CA (US)

(72) Inventor: Karl Kozak, San Diego, CA (US)

(73) Assignee: KORE Essentials Inc., La Mesa, CA (US)

( * ) Notice: Subject to any disclaimer, the term of this patent is extended or adjusted under 35 U.S.C. 154(b) by 0 days.

(21) Appl. No.: 17/482,054

(22) Filed: Sep. 22, 2021

(65) Prior Publication Data

US 2022/0090878 A1 Mar. 24, 2022

Related U.S. Application Data

(60) Provisional application No. 63/082,350, filed on Sep. 23, 2020.

(51) Int. Cl.
*F41C 33/04* (2006.01)

(52) U.S. Cl.
CPC ..... *F41C 33/048* (2013.01); *F41C 33/041* (2013.01)

(58) Field of Classification Search
CPC ..... F41C 33/041; F41C 33/048; A45F 2200/0591; Y10S 206/818; Y10S 211/01
See application file for complete search history.

(56) References Cited

U.S. PATENT DOCUMENTS

| | | | | |
|---|---|---|---|---|
| 7,146,651 | B1 * | 12/2006 | Lapin | A41D 19/01594 2/338 |
| 8,739,453 | B1 | 6/2014 | Conner | |
| 10,299,571 | B2 * | 5/2019 | Eberle | A45F 5/021 |
| 2007/0172019 | A1 | 7/2007 | Ballarta | |
| 2014/0224847 | A1 * | 8/2014 | Miller | F41C 33/04 224/183 |
| 2015/0144673 | A1 * | 5/2015 | Dahl | F41C 33/0236 224/587 |
| 2015/0305463 | A1 * | 10/2015 | Huyke-Phillips | B29C 44/12 112/475.08 |
| 2019/0316875 | A1 | 10/2019 | Schmadeka | |
| 2022/0018631 | A1 * | 1/2022 | Strzalko | F41C 33/0218 |

* cited by examiner

*Primary Examiner* — Corey N Skurdal
(74) *Attorney, Agent, or Firm* — CP LAW GROUP PC; Cy Bates

(57) ABSTRACT

A system for suspending articles of firearms is disclosed, the system including one or more pockets, one or more magnets disposed in the one or more pockets, and a firearm article wherein the firearm article and the one or more magnets are magnetically coupled so as to form an engagement to at least a portion of the one or more pockets. In one embodiment, a backpack is disclosed having a lumbar compartment disposed between a storage compartment and a user wearing the backpack. The lumber compartment comprises a magnet-containing pocket, the magnet-containing pocket having a magnet configured to suspend a firearm article magnetically coupled therewith. The backpack further includes one or more access points for allowing access to a user for efficiently grabbing a firearm article suspended while wearing the backpack.

12 Claims, 5 Drawing Sheets

FIREARM ARTICLE SUSPENSION SYSTEM

CROSS-REFERENCE TO RELATED APPLICATION

This application claims benefit of priority with U.S. Provisional Application Ser. No. 63/082,350, filed Sep. 23, 2020, the entire contents of which are hereby incorporated by reference.

BACKGROUND

Field of the Invention

This invention relates to a system for storing and transporting firearms and their accessories; and more particularly to a firearm article suspension system including magnets and pockets containing the magnets.

Description of the Related Art

One of the primary purposes of a firearm is for the protection of oneself and the protection of others. When situations arise that may require a firearm, the time needed to grab the firearm could be the difference between life and death. It is desirable to provide a user a faster means to seize and deploy their firearm (and firearm accessories).

A common means to holding a firearm, especially in a backpack-type carrying device, is a holster or stitching that mimics the outline of a holster. But using a holster provides several limitations. First, the firearm can only be held in a position that the holster is designed to hold. Alternate positions are not feasible, even if those alternate positions are more advantageous to the user when reaching for the firearm. Another limitation is that a holster still allows room for the firearm to move, albeit slightly, which means the firearm can be in an alternative position from when it was originally inserted. This can be disadvantageous if the user were to fumble while grabbing the firearm, wasting precious time. Furthermore, if the firearm is not pulled from the holster in a specific way, the holster may interfere with the firearm while exiting the holster, thus creating a delay for deployment. Lastly, the holster does not efficiently hold other items beyond the actual firearm, such as one or more firearm magazines.

Conner, U.S. Pat. No. 8,739,453, issued Jun. 3, 2014, discloses a magnetic firearm support which includes a base, at least one magnet in the base and a firearm cradle having a firearm space carried by the base.

Eberlie, U.S. Pat. No. 10,299,571, issued May 28, 2019, discloses a backpack which includes a handgun pocket with at least one access slit arranged in the main bag. Each of the access slits has at least one magnetic closure for keeping the access slit in a normally closed position.

Ballarta el al, U.S. Patent Application 2007/0,172,019, published Jul. 26, 2007, discloses a backpack providing a lumber firearms compartment which combines ease of access to the firearm with the needed concealment of the firearm and the requisite comfort to the backpack wearer for long term storage of the firearm. Various related configurations of the lumber firearms compartment are disclosed.

Schmadeka, U.S. Patent Application 2019/0,316,875, published Oct. 17, 2019 discloses a garment pocket for the concealed carrying of a gun which includes an inside gun pocket having a front panel and a back panel and having a top opening between the front panel and back panel. An elastic band is affixed across the width and proximate the top of the front panel.

There is a need for improvements to allow for faster and easier access to a firearm and its accessories.

SUMMARY

A system for suspending articles of firearms is disclosed, the system comprises one or more pockets, one or more magnets disposed in the one or more pockets, and a firearm article wherein the firearm article and the one or more magnets are magnetically coupled so as to form an engagement to at least a portion of the one or more pockets.

In one embodiment, a backpack is disclosed having a lumbar compartment disposed between a storage compartment and a user wearing the backpack. The lumber compartment comprises a magnet-containing pocket, the magnet-containing pocket having a magnet configured to suspend a firearm article magnetically coupled therewith. The backpack further comprises one or more access points disposed at a first side, a second side, or both the first and second sides of the lumbar compartment for allowing access to the user for efficiently grabbing a firearm article suspended while wearing the backpack.

BRIEF DESCRIPTION OF THE DRAWINGS

These and other features of the invention will become apparent to one having the ordinary level of skill in the art upon a thorough review of the following details and descriptions, particularly when reviewed in conjunction with the drawings, wherein.

DETAILED DESCRIPTION OF EMBODIMENTS

Figure 1:
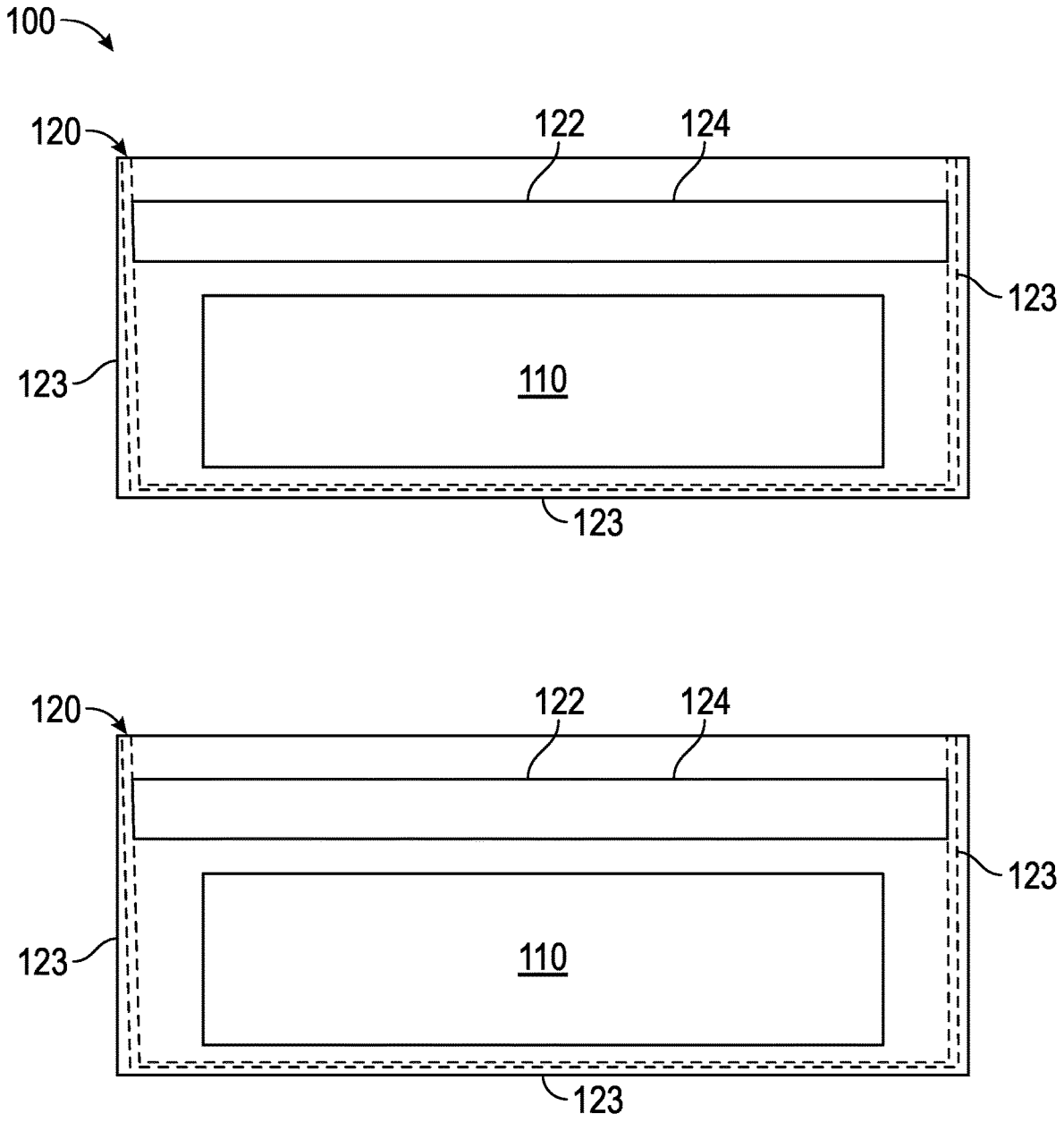
FIG. 1 shows a front view of a firearm article suspension system according to a first embodiment.

For purposes of explanation and not limitation, details and descriptions of certain preferred embodiments are hereinafter provided such that one having ordinary skill in the art may be enabled to make and use the invention. These details and descriptions are representative only of certain preferred embodiments, however, and a myriad of other embodiments which will not be expressly described will be readily understood by one having skill in the art upon a thorough review of the instant disclosure. Accordingly, any reviewer of the instant disclosure should interpret the scope of the invention only by the claims, as such scope is not intended to be limited by the embodiments described and illustrated herein.

General Description of Embodiments

In a first general embodiment, a backpack is disclosed. The backpack comprises a storage compartment, a back portion and a lumbar compartment disposed between the storage compartment and the back portion. The lumbar compartment comprises a proximal portion and a distal portion opposite the proximal portion, and further comprises a first side and a second side opposite the first side. One or more access points are disposed at the first side, the second side, or both, wherein the one or more access points configured to open by a zipper. A plurality of magnet-containing pockets is disposed within the lumbar compartment at the distal portion, the plurality of magnet-containing pockets having a vertical alignment. One or more magnets are contained within the plurality of magnet containing pockets, wherein the one or more magnets are configured to magnetically couple to a firearm article so as to form a bond to at least a portion of the plurality of magnet-containing pockets.

In some embodiments, each of the plurality of magnet-containing pocket further may comprise a series of individual sub-pockets wherein each of the individual sub-pockets is configured to receive the or more magnets.

Generally, the plurality of magnet-containing pockets may be enclosed to retain the one or more magnets. Additionally, or alternatively, the plurality of magnet-containing pockets may open to allow for reconfiguration of the one or more magnets.

In a second general embodiment, an alternative backpack is disclosed. The backpack comprises a storage compartment, a back portion and a lumbar compartment disposed between the storage compartment and the back portion. The lumbar compartment comprises a proximal portion and a distal portion opposite the proximal portion, and further comprises a first side and a second side opposite the first side. The backpack further comprises a magnet-containing pocket and one or more magnets, wherein the magnet-containing pocket being configured to receive the or more magnets. The one or more magnets are configured to magnetically couple to a firearm article so as to form a bond to at least a portion of the magnet-containing pocket.

In some embodiments, the magnet-containing pocket may be disposed on the proximal portion. In other embodiments, the magnet-containing pocket may be disposed on the distal portion.

In some embodiments, the backpack may further comprise a plurality of magnet-containing pockets having a vertical alignment.

In some embodiments, magnet-containing pocket may further comprise a series of individual sub-pockets wherein each of the individual sub-pockets is configured to receive the or more magnets.

In some embodiments, the magnet-containing pocket may be enclosed to retain the one or more magnets. In some embodiments, the magnet-containing pocket may open to allow for reconfiguration of the one or more magnets. Means of allowing opening and closing of the magnet-containing pocket may include an engagement element such as a zipper, hook and look fastener, or the like.

In some embodiments, the backpack may further comprise a one or more access points wherein access to the magnet-containing pocket is through the one or more access points.

In third general embodiment, a firearm article suspension system is disclosed. The firearm article suspension system comprises one or more magnets, and a magnet-containing pocket, where the magnet-containing picket is configured to receive the or more magnets. The firearm article suspension system further comprises a firearm article wherein the one or more magnets and the firearm article are magnetically coupled so as to form a bond to at least a portion of the magnet-containing pocket.

In some embodiments, the magnet-containing pocket may further comprise a series of individual sub-pocket wherein each of the individual sub-pockets is configured to receive the or more magnets.

In some embodiments, the magnet-containing pocket may be enclosed to retain the one or more magnets. Additionally, the magnet-containing pocket may open to allow for reconfiguration of the one or more magnets.

In some embodiments, the system may further comprise a one or more access points wherein access to the firearm suspension system is through the one or more access points.

In some embodiments, the firearm article suspension system may be disposed in a bag, such as a backpack, waist bag, handheld bags, crossbody bags, shoulder bags, athletic bags, functional bags, luggage, purses, or the like.

First Illustrated Embodiment

Now turning to the drawings, FIG. 1 shows a front view of a firearm article suspension system (100) according to a first embodiment. The system comprises two magnet-containing pockets (120). Each of the magnet-containing pockets may have one or more magnets (110) disposed inside. The magnets are visually represented for illustrative purposes and will normally not be viewable through the magnet-containing pocket. Each magnet-containing pocket comprises a pocket opening (122) and stitching (123). The pocket opening is capable of being in an enclosed state so as to retain the magnets, or alternatively, an open state to allow for addition or substitution of magnets. The pocket opening comprises an engagement element (124) (e.g. a button, zipper, hook and loop fastener, and the like) to allow for ease of opening and closing. Generally, the pockets should be in the relative shape of the firearm article which will be suspended, for example, the shape may include a linear shape. In alternative embodiments, the magnet-containing pocket does not comprise a pocket opening and instead comprises stitching surrounding the magnet contained therein for secure holding.

Optionally, on either side of the pockets may be access points (360, FIG. 4), which may be used to conceal view of a contained firearm and/or accessories, and also may be configured to provide quick access to the articles of a firearm that may be suspended at the pockets. Access points may comprise a zipper, hook and loop fastener, or the like. The magnets are stitched within the magnet-containing pockets and typically are the same general shape as their respective pockets and configured to nest within the respective pocket with a snug fitment so as to maximize the magnet surface area and stabilize the magnet within the pocket. This allows for greater magnetic coupling for purposes of holding firearm articles of various weights.

Figure 2:
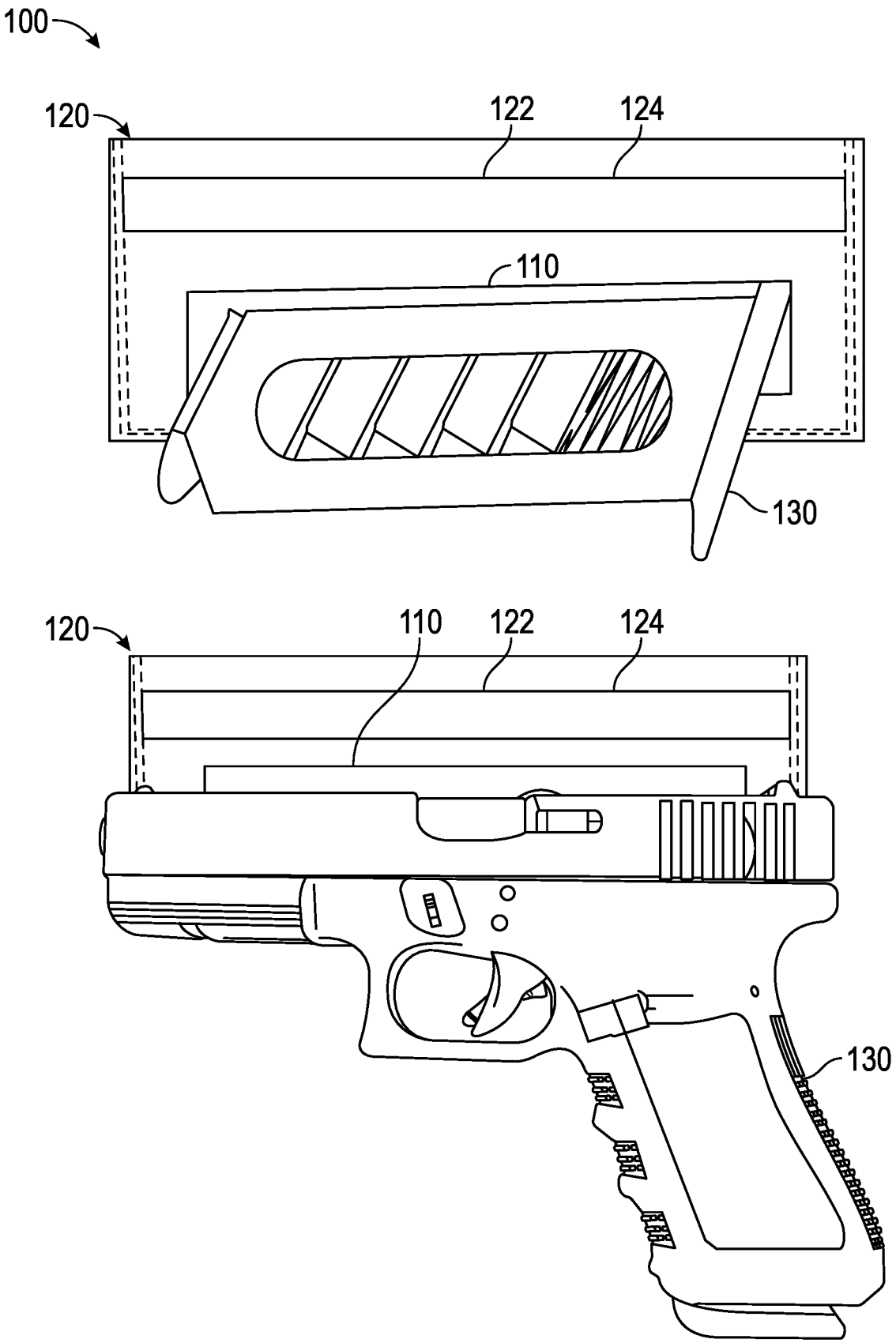
FIG. 2 shows a front view of the firearm article suspension system according to a first embodiment suspending firearm articles.

FIG. 2 shows a front view of the firearm suspension system (100). The system includes at least two magnet-containing pockets (120), each pocket containing at least one magnet (110). The figure further shows various firearm articles (130), namely a handgun and a magazine, that can be suspended by the system. The magnet is nested within the pocket, and the firearm article is external to the pocket. The firearm article is magnetically coupled to the magnet so as to form an engagement to at least a portion of the magnet-containing pocket. In this regard, the magnet(s) and firearm operate to sandwich fabric of the pocket therebetween, effectively retaining the firearm article at the pocket, wherein the magnet-containing pocket is fixed to a portion of a backpack or other similar object. In FIG. 2, the magazine is suspended above the handgun so the handle of the handgun will not interfere the magazine. However, it should be appreciated by one having skill in the art that the pockets may be disposed far enough from each other that the handgun could alternatively be suspended over the magazine.

Furthermore, depending on number and location of the magnet-containing pockets (120), the system will allow a user a variety of options regarding what types of firearm articles, in which order, and in what position the user desires. For example, in the two-pocket configuration as shown, the configuration may comprise the magazine on the upper magnet-containing pocket and the handgun at the bottom magnet-containing pocket as shown. However, the system may also comprise, for example and without limitation, two magazines or two handguns. A firearm article such as a handgun could be situated in either a left or right position, depending on which access point the user will be using.

The fabric of the pocket is generally one that is configured to promote magnetic engagement with a magnet and a firearm article on opposite sides thereof. For example, the thickness of the pocket material is generally less than one-eighth inch. Additionally, the material of the pocket should preferably be selected as one that does not mark or scratch the firearm article, such as a microfiber, nylon or similar fabric that would be appreciated by one having skill in the art.

Second Illustrated Embodiment

Figure 3:
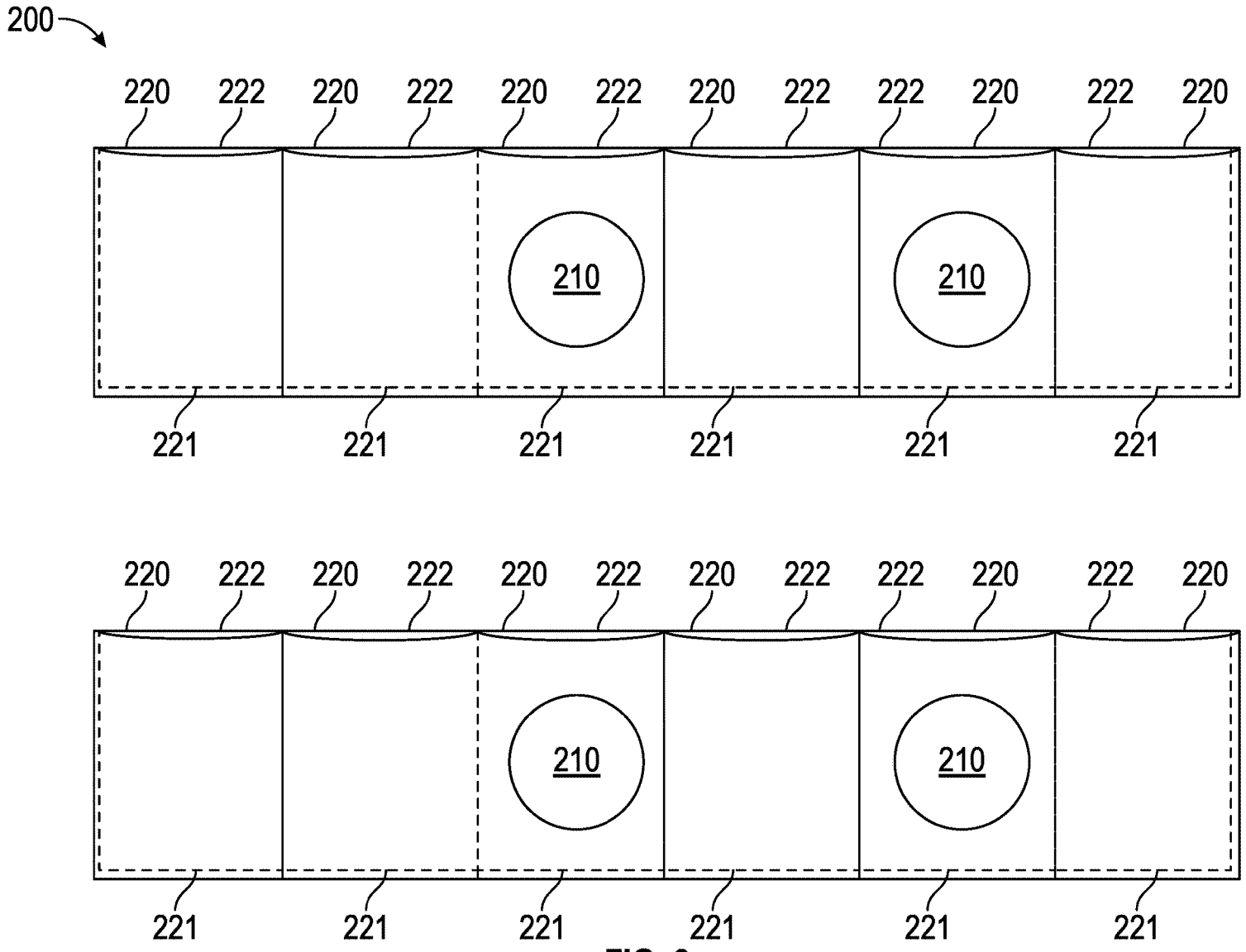
FIG. 3 shows a front view of the firearm article suspension system according to a second embodiment with magnets inserted into a plurality of pockets of the system.

FIG. 3 shows a front view of a firearm article suspension system (200) according to a second embodiment. The firearm article suspension system includes magnet-containing pockets (220) with magnets (210) visually shown for illustrative purposes. Each of the magnet-containing pockets comprises a plurality of smaller individual sub-pockets (221). In this figure, the sub-pockets are shown as each having a pocket opening (222) so as to give the user the option of where to place the magnets.

As shown, the individual sub-pockets (221) are open, which allows the user to place certain types and sizes of magnets in a particular configuration depending on the firearm article which is being suspended. An open pocket may comprise a pocket or sub-pocket with no engagement element, or one that is selectively enclosed via a button, zipper, magnetic engagement, hook and loop fastener, and the like.

The second embodiment of the firearm article suspension system (200) having a plurality of smaller individual sub-pockets may comprise a myriad of magnet (210). configurations. In one configuration, a magnet is placed at each end of the series to hold a long yet relatively light firearm article. In a second configuration, a magnet is placed in additional sub-pockets for firearm article comprising additional weight. In a third configuration. It should also be appreciated that a plurality of magnets could be used in one of the smaller individual pockets depending on both magnet strength and the size of the individual smaller pockets.

Third Illustrated Embodiment

Figure 4:
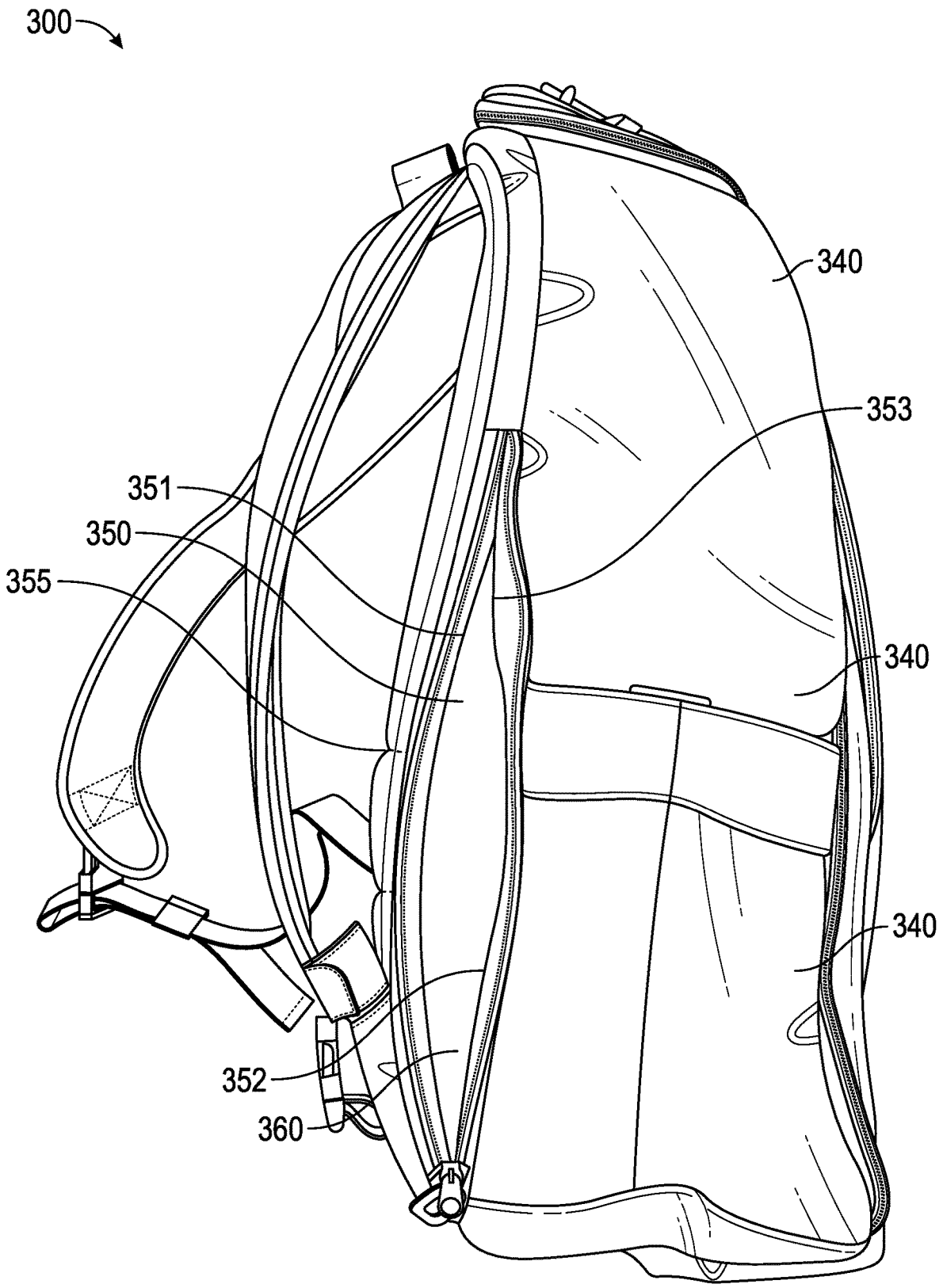
FIG. 4 shows a side view of a backpack having a lumbar compartment according to a third illustrated embodiment.

FIG. 4 shows a side view of a backpack (300) having a lumbar compartment (350) according to a third illustrated embodiment. The lumbar compartment is disposed between a storage compartment (340) and a back portion (355), where the back portion is configured to rest against a user's back when the backpack is typically worn. The lumbar compartment is shown having an access point (360) disposed on a first side (353) in an opened, or accessible, position. The lumbar compartment further comprises a proximal portion (351) and a distal portion (352) opposite the proximal portion, wherein the proximal portion is defined as the portion of the lumbar compartment closest to and resting against a user's back while wearing the backpack. The backpack further comprises a magnet-containing pocket (320, FIG. 5) disposed within the lumbar compartment such that a user could reach behind their back and grab a firearm article suspended by magnet-containing pocket and one or magnets disposed therein.

In a preferable embodiment, distance between each of the magnet-containing pockets (320, FIG. 5) and a user's back is minimized so as to decrease force from the user required to disengage the firearm article suspended therewith. In one embodiment, the magnet-containing pockets are disposed on the proximal portion (351). In an alternative embodiment, the magnet-containing pockets are disposed on the distal portion (352).

As shown, the access point (360) comprises zippers which are configured to be pulled downwards to allow access through the access point and into the lumbar compartment. Downwards opening zippers are preferable as it generally requires less strength from a user to open with a downwards motion while reaching behind their back. In some embodiments, the access point is additionally and or/alternatively positioned on a second side (not shown), opposite the first side (353). Other means for opening the one or more access points may include hook and look, button, or the like.

Figure 5:
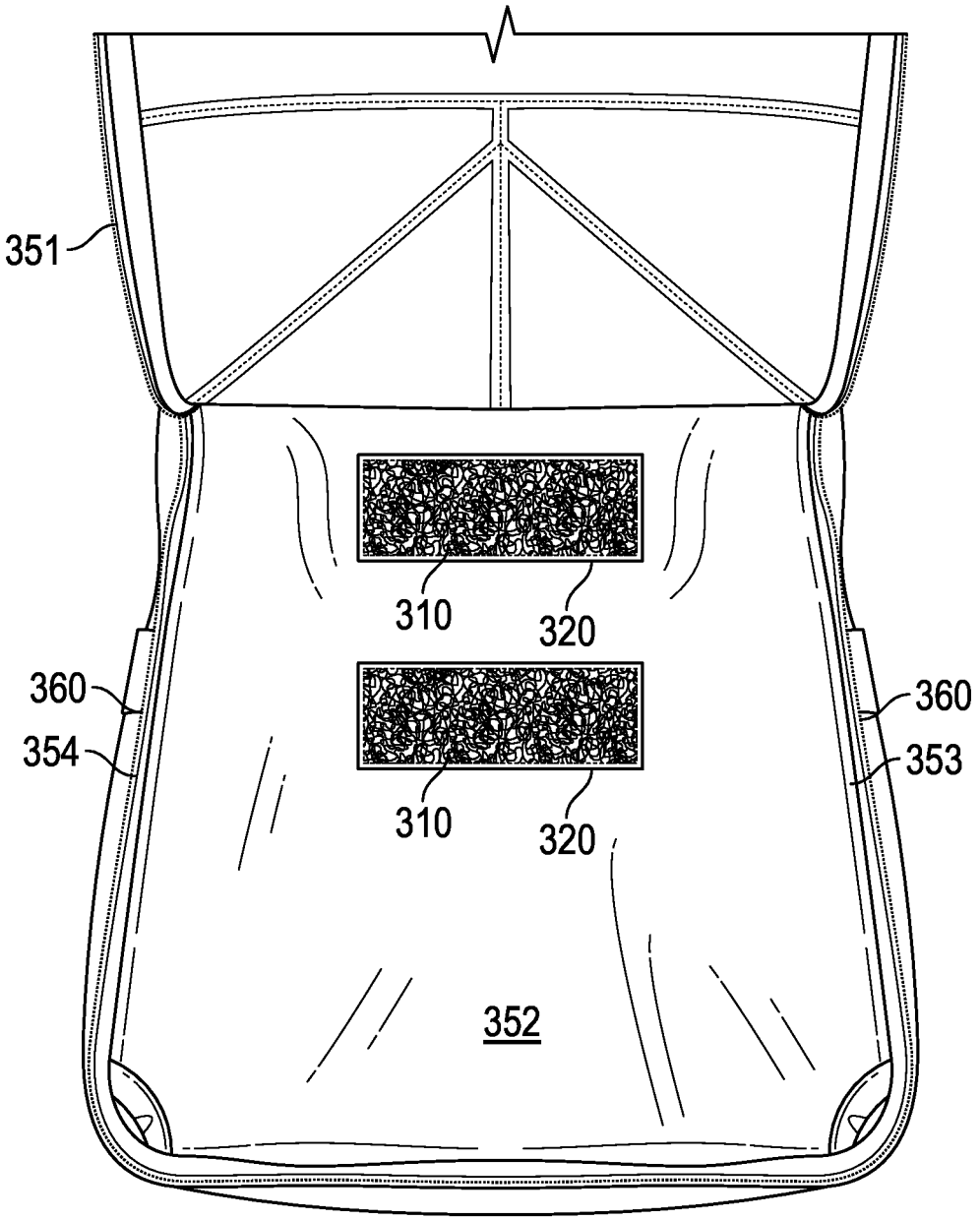
FIG. 5 shows a front view of a distal portion of the lumbar compartment according to the third illustrated embodiment.

FIG. 5 shows a front view of a distal portion (352) of the lumbar compartment (350) according to the third illustrated embodiment. The proximal portion (351), or portion adjacent to a user's back, is pulled away so as to expose the distal portion. The distal portion includes two magnet-containing pockets (320) in a vertical alignment with respect to each other, wherein each of the magnet-containing pockets comprises a magnet (310) encapsulated therein. It will be appreciated that alternative amounts and configurations of magnet-containing pockets may also be used. The lumbar compartment comprises a first side (353) and a second side (354) opposite the first side. At least one of the first and second sides comprise an access point (360) where the user is able to open and reach inside the lumbar compartment while wearing the backpack (300, FIG. 4) to grab a firearm article contained therein.

Manufacturing

The magnet may be obtained commercially or custom fabricated. Common materials for permanent magnets are cobalt, nickel, iron, and neodymium. Neodymium is especially popular in many applications given its high magnetic strength and low relative weight. Magnets can come in a variety of shapes and sizes depending on the particular application.

In some embodiments, a Polymagnet may be used, for example one that is configured to direct or concentrate a magnetic field of the magnet at one surface thereof. See, for example, http://www.polymagnet.com.

The pockets can be fabricated from garment materials such as nylon, PVC fabric, cotton canvas, cordura or any other material known to those in the skill of the art that may be appreciate for purposes of pockets. Given the heavy use that the pockets may be subjected to, fabrics that are more durable are preferred.

While various details, features, and combinations are described in the illustrated embodiments, one having skill in the art will appreciate a myriad of possible alternative combinations and arrangements of the features disclosed herein. As such, the descriptions are intended to be enabling only, and non-limiting. Instead, the spirit and scope of the invention is set forth in the appended claims.

FEATURE LIST firearm article suspension system (100; 200)
magnet (110; 210; 310)
magnet-containing pocket (120; 220; 320)
individual sub-pockets (221)
pocket opening (122; 222)
stitching (123; 223; 224)
engagement element (124)
firearm article (130)
backpack (300)
storage compartment (340)
lumbar compartment (350)
back portion (355)
proximal portion (351)
distal portion (352)
first side (353)
second side (354)
access point (360)

What is claimed is:

1. A backpack comprising:
a storage compartment;
a back portion;
a lumbar compartment disposed between the storage compartment and the back portion, the lumbar compartment comprising a proximal portion and a distal portion opposite the proximal portion, and further comprising a first side and a second side opposite the first side;
a plurality of magnet-containing pockets disposed within the lumbar compartment, the plurality of magnet-containing pockets forms a single column
a first access point disposed on the first side, a second access point disposed on the second side, wherein the lumbar compartment is devoid of magnets between the first access point and the single column of the plurality of magnet-containing pockets, and further wherein the lumbar compartment is devoid magnets between the second access point and the single column of the plurality of magnet-containing pockets; and
one or more magnets contained within the plurality of magnet-containing pockets;
wherein the one or more magnets are configured to magnetically couple to a firearm article so as to form a bond to at least a portion of the plurality of magnet-containing pockets.

2. The backpack of claim 1, each of the plurality of magnet-containing pocket further comprising a series of individual sub-pockets wherein each of the individual sub-pockets is configured to receive the or more magnets.

3. The backpack of claim 1, wherein the plurality of magnet-containing pockets is enclosed to retain the one or more magnets.

4. The backpack of claim 1, wherein the plurality of magnet-containing pockets is open to allow for reconfiguration of the one or more magnets.

5. A backpack comprising:
a storage compartment;
a back portion;
a lumbar compartment disposed between the storage compartment and the back portion, the lumbar compartment comprising a proximal portion and a distal portion opposite the proximal portion, and further comprising a first side and a second side opposite the first side;
a plurality of magnet-containing pockets disposed within the lumbar compartment wherein each of the plurality of magnet-containing pockets comprises a vertical alignment with each other of the plurality of magnet-containing pockets; and
one or more magnets contained within the plurality of magnet-containing pockets;
wherein the one or more magnets are configured to magnetically couple to a firearm article so as to form a bond to at least a portion of at least one of the plurality of magnet-containing pockets.

6. The backpack of claim 5, wherein the magnet-containing pocket is disposed on the proximal portion.

7. The backpack of claim 5, wherein the magnet-containing pocket disposed is on the distal portion.

8. The backpack of claim 5, the magnet-containing pocket further comprising a series of individual sub-pockets wherein each of the individual sub-pockets is configured to receive the or more magnets.

9. The backpack of claim 5, wherein the magnet-containing pocket is enclosed to retain the one or more magnets.

10. The backpack of claim 5, wherein the magnet-containing pocket is open to allow for reconfiguration of the one or more magnets.

11. The backpack of claim 5, further comprising a one or more access points wherein access to the magnet-containing pocket is through the one or more access points.

12. The backpack of claim 5, further comprising a first access point disposed on the first side, a second access point disposed on the second side, wherein the lumbar compartment is devoid of magnets between the first access point and the plurality of magnet-containing pockets, and further wherein the lumbar compartment is devoid magnets between the second access point and the plurality of magnet-containing pockets.

* * * * *